United States Patent [19]

Falomo

[11] 4,188,108

[45] Jan. 12, 1980

[54] DEVICE FOR CLIPPING STRIPS OF PHOTOGRAPHIC PAPER TO DEVELOPERS COMPRISING A FLAT CONVEYOR BELT

[76] Inventor: Lodovico Falomo, Orcenigo Inferiore, Zoppola (Pordenone), Italy

[21] Appl. No.: 907,616

[22] Filed: May 19, 1978

[30] Foreign Application Priority Data

May 31, 1977 [IT] Italy ..... 24214A/77

[51] Int. Cl.[2] ..... G03D 13/10

[52] U.S. Cl. ..... 354/345; 24/255 R; 226/92

[58] Field of Search ..... 354/320, 321, 340, 343, 354/344, 345, 346; 24/67.3, 167, 253, 255; 226/91, 92, 170, 173; 352/235; 271/205

[56] References Cited

U.S. PATENT DOCUMENTS

| | | | |
|---|---|---|---|
| 2,770,179 | 11/1956 | Dye et al. | 354/320 |
| 2,878,924 | 3/1959 | Dye et al. | 354/321 |
| 3,178,124 | 4/1965 | Trout et al. | 354/321 |
| 3,713,649 | 1/1973 | Kempen et al. | 226/92 |
| 3,810,568 | 5/1974 | Kwiaikowski et al. | 226/92 |
| 4,055,289 | 10/1977 | Kaiser et al. | 226/92 |
| 4,065,042 | 12/1977 | Zielinski | 354/321 |
| 4,072,260 | 2/1978 | Dove | 354/345 |

*Primary Examiner*—L. T. Hix
*Assistant Examiner*—Alan Mathews
*Attorney, Agent, or Firm*—Cushman, Darby & Cushman

[57] ABSTRACT

This invention relates to a device for clipping strips of photographic paper to the flat conveyor belts of conventional developers for conveying in closed cycle through various tanks containing the necessary chemicals for development. The device according to the invention comprises a bar to which the photographic paper is connected, a hook at one end of said bar and a resilient clip fixed to the bar at such a distance from the hook as to be able to clamp a conveyor belt hooked by the hook.

2 Claims, 3 Drawing Figures

DEVICE FOR CLIPPING STRIPS OF PHOTOGRAPHIC PAPER TO DEVELOPERS COMPRISING A FLAT CONVEYOR BELT

This invention relates to a device for clipping strips of photographic paper to the flat conveyor belts of conventional developers for conveying in closed cycle through various tanks containing the necessary chemicals for development.

The object of the invention is to provide a clipping device which enables the strips of photographic paper to be developed, to be clipped very simply and rapidly to the conveyor belt of the developer, thus enabling very quick developers which have an extremely limited clipping space to be used.

This object is attained according to the invention by a device for clipping strips of photographic paper to a flat conveyor belt of a developer, comprising a bar to which the photographic paper is connected, a hook at one end of said bar for hooking to the flat belt of the developer, and a resilient clip fixed to the bar at a distance from the hook such as to be able to clamp the conveyor belt on to the bar when hooked by the hook.

Figure 1:
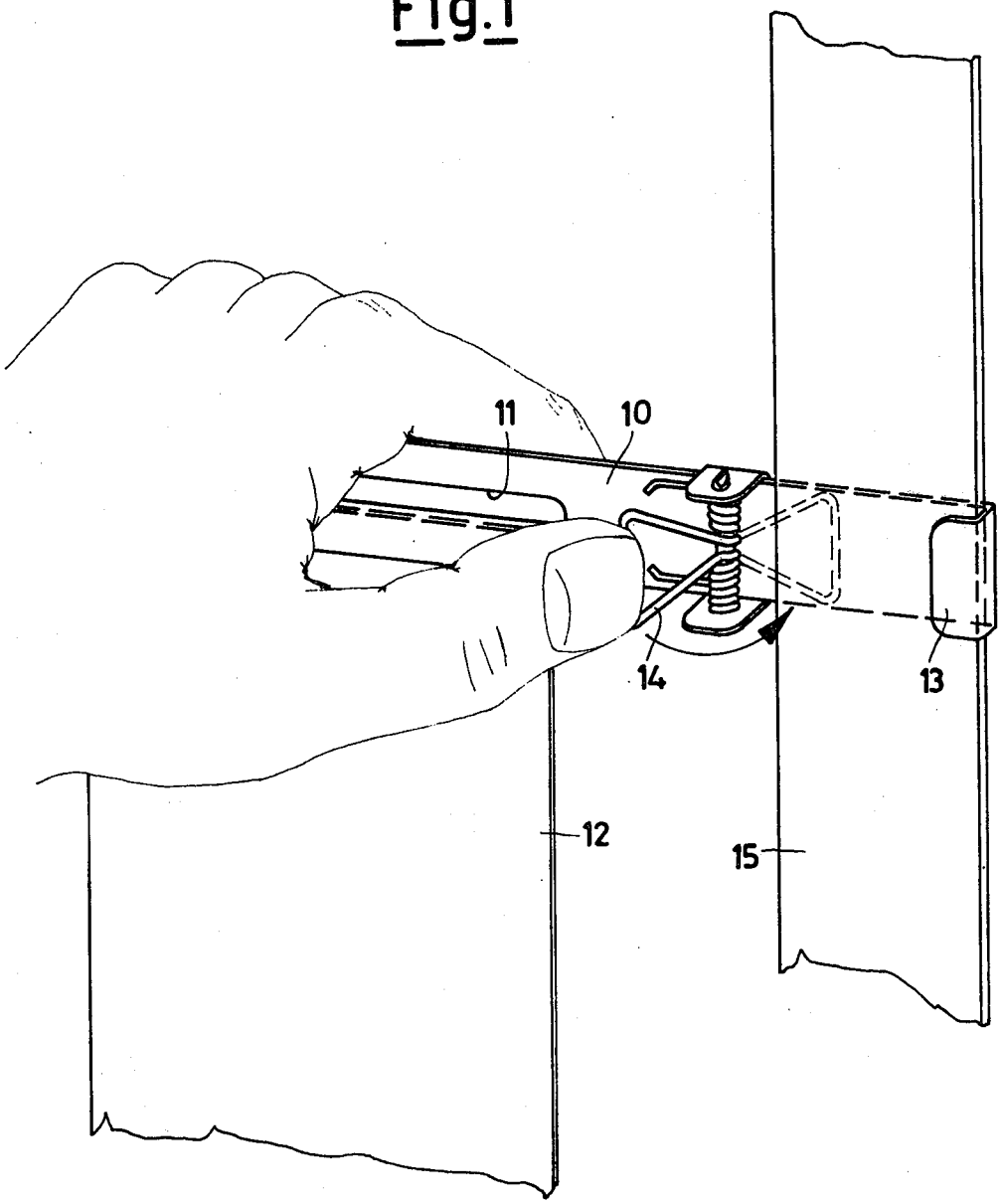
Figure 2:
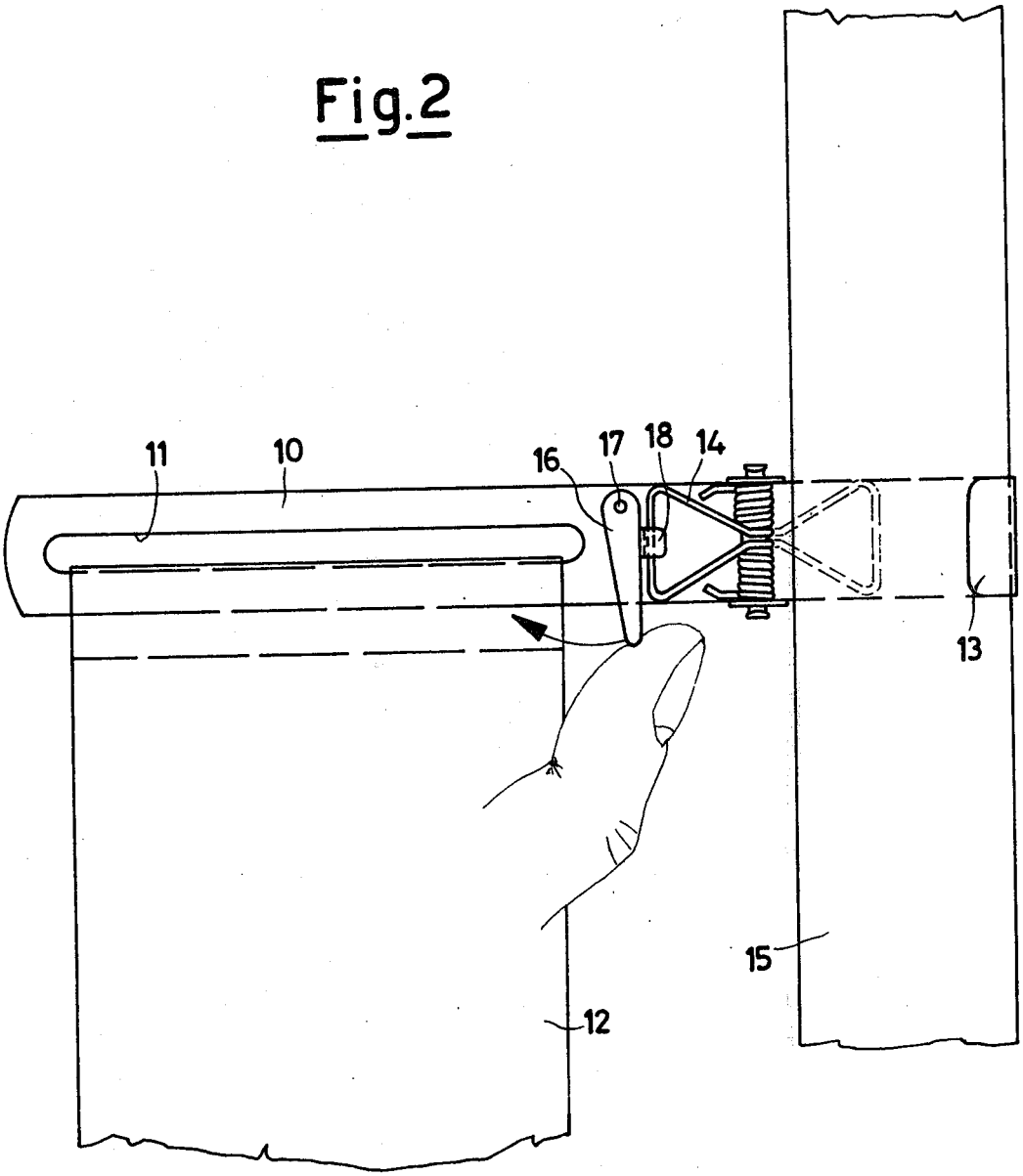
Figure 3:
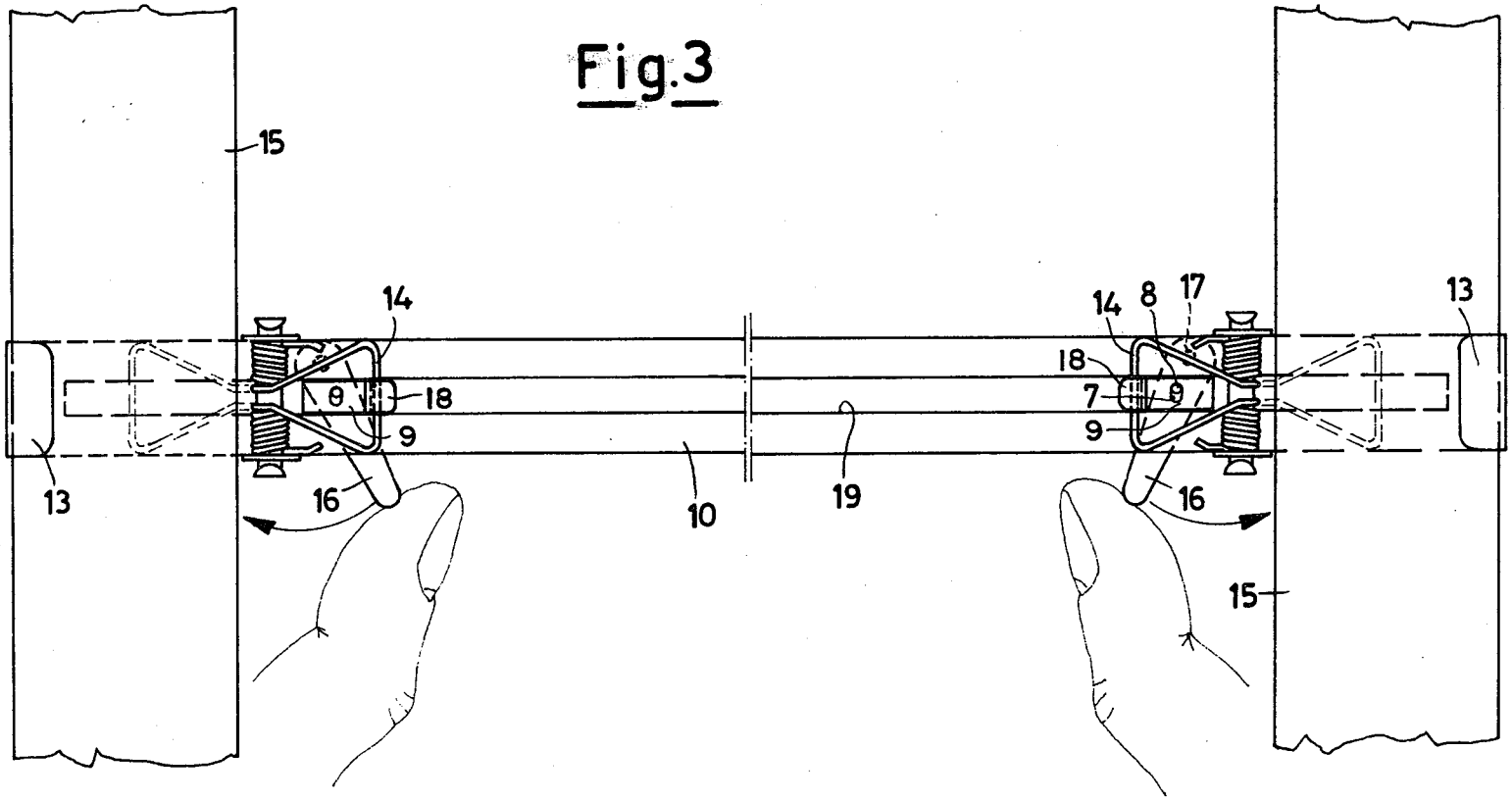

The structural and operational characteristics of the invention and its advantages will be more evident from the description given hereinafter with reference to the accompanying drawings in which:

FIG. 1 shows the device according to the invention in the process of being clipped to the flat conveyor belt of a developer; and FIGS. 2 and 3 are modifications of the invention.

With reference to FIG. 1 of the drawings, the clipping device according to the invention comprises a flat bar 10 with a slot 11 into which the photographic paper 12 is fixed in the normal manner.

At one end of the bar 10 there is a hook 13 with which a resilient clip 14 suitably spaced apart from the hook 13 cooperates.

In this manner, after the operator has fixed the photographic paper 12 to the bar 10, he grips this latter in the manner shown in FIG. 1, i.e. by preloading the resilient clip 14. The operator then hooks the hook 13 on to the flat conveyor belt 15 of the developer and allows the clip 14 to snap into the position shown by the dashed line in FIG. 1, in which it clamps the bar 10 to the belt 15.

A retention means able to hold it firmly in the preloaded position may also cooperate with the resilient clip 14 (FIGS. 2 and 3).

This retention means in the embodiment of FIG. 2 comprises a lever 16 pivoted at 17 to the bar 10 and with a lateral tooth 18 for retaining the clip 14 in the preloaded position shown in the figures by a full line.

The operator may thus firstly lock the clip 14 in the preloaded position, then comfortably hook the hook 13 on to the belt 15 without having to preoccupy himself with retaining the preloaded clip with the finger, and then release the clip by rotating the lever 16 in the clockwise direction shown by the arrow in FIG. 2.

As is evident from the drawing, in the embodiment of FIG. 2 the lever 16 is external to the clip 14 when in the preloaded position, and lies on the same face of the bar 10.

However, in the embodiment of FIG. 3, the lever 16 is on the other face of the bar 10 to the face on which the clip 14 is mounted, and a tooth 18 extends from a slider 9 slidable in a slot 19 in the bar 10. For the correct transmission of the movement, a pin 8 on the lever 16 is engaged in a slot 7 in the slider 9. The tooth 18 projects from the slot 19 of the bar 10 to engage and lock the clip in its preloaded position, when the lever 16 is in the angular position shown in FIG. 3. In order to release the clip 14, the lever 16 should be rotated about the pivot 17 to cause the slider 9 to move back and to disengage the tooth 18 from the clip.

This latter embodiment of the invention is particularly suitable for simultaneously clipping to two opposing belts 15 of the developer. In this case, the lever 16 of the device relative to the right hand belt 15 (looking at the drawing) is rotated in the anti-clockwise direction, while the lever of the other device, relative to the left hand belt, is rotated in the clockwise direction. In this manner the operator releases the resilient clips with an automatic closure movement of his thumbs.

The clipping device according to the invention thus enables the developer conveying belts to be clipped by a very simple operation in a very short time, because of which it enables rapid developers with a limited space available for clipping the photographic paper to be used.

What we claim is:

1. A device for clipping strips of photographic paper to a flat conveyor belt of a developer, comprising a bar to which the photographic paper is to be connected, a hook at one end of said bar for hooking to the flat belt of the developer, a resilient clip having a preloaded position and a released position fixed to the bar at a distance from the hook such that the clip in its released position is able to clamp the conveyor belt on to the bar when the bar is hooked to the belt by the hook, and a releasable retention means cooperating with the clip to maintain it in its preloaded position.

2. A device as claimed in claim 1, wherein said retention means includes a lever pivoted to the bar and a tooth arranged on the lever to engage with the clip.

* * * * *